US005119734A

United States Patent [19]

Schwarzkopf

[11] Patent Number: 5,119,734

[45] Date of Patent: Jun. 9, 1992

[54] CHASSIS FOR RAIL-BOUND EXHIBITION VEHICLES

[76] Inventor: Anton Schwarzkopf, Marienstr. 5, 8908 Ziemetshausen (Maria Versperbild), Fed. Rep. of Germany

[21] Appl. No.: 581,476

[22] Filed: Sep. 12, 1990

[30] Foreign Application Priority Data

Sep. 14, 1989 [DE] Fed. Rep. of Germany ... 8911037[U]

[51] Int. Cl.[5] ..... B61F 5/00

[52] U.S. Cl. ..... 104/246; 104/63

[58] Field of Search ..... 104/53, 56, 57, 55, 104/63, 64, 65, 66, 246, 118, 119; 105/141, 199.1

[56] References Cited

U.S. PATENT DOCUMENTS 3,941,060 3/1976 Morsback ..... 104/63
4,831,937 5/1989 Yamada ..... 104/246

FOREIGN PATENT DOCUMENTS 2442268 3/1976 Fed. Rep. of Germany ..... 104/246
8717429 12/1989 Fed. Rep. of Germany .
1307448 9/1962 France .

*Primary Examiner*—Robert J. Oberleitner
*Assistant Examiner*—Mark T. Le
*Attorney, Agent, or Firm*—McGlew and Tuttle

[57] ABSTRACT

A chassis for rail-bound amusement vehicles including a vehicle frame with a bearing block connected to the frame and a bearing bracket elastically mounted on the bearing block via a ball-and-socket joint. Wheel shoes are provided for hinges with supporting pairs wheels such that the wheels may be adjusted against a rail in a hinged manner from the top and bottom as well as from the side. The bearing bracket is also connected to the vehicle frame by a ball-and-socket joint, connecting the bearing bracket to the connecting rod which extends at right angles to the direction of travel and which is connected to the vehicle frame.

8 Claims, 3 Drawing Sheets

CHASSIS FOR RAIL-BOUND EXHIBITION VEHICLES

FIELD OF THE INVENTION

The present invention pertains to a chassis for rail-bound amusement vehicles, especially elevated railroads, comprising track wheels arranged in pairs, which are adjusted against the rail from the top and bottom as well as from the side in a hinged manner by means of wheel shoes mounted on a bearing bracket, wherein the bearing bracket is connected to the frame of the vehicle in a hinged manner.

BACKGROUND OF THE INVENTION

Chassis of this design have been known in large amusement establishments, especially roller coasters, loopers, and the like. The rails used are mainly pipes connected by traverses, against which track wheels with cylindrical generated surfaces are adjusted from the top, bottom, and the outside. It has been known, e.g., from West German Utility Patent No. DE-GM 83,02,675, that the track wheels are mounted in groups in bearing blocks and these bearing blocks are arranged on the chassis in a hinged manner. It shall be achieved in this manner or in another similar manner that the contact of all track wheels with the rail is maintained, especially on curved sections or uphill or downhill sections.

Amusement establishments of the above-mentioned type have ever-increasing dimensions, as a consequence of which the vehicles have substantially higher speeds and are correspondingly exposed to high centrifugal forces.

SUMMARY AND OBJECTS OF THE INVENTION

A primary object of the present invention is to develop a chassis for such rail-bound amusement vehicles, which travel at high speeds, which permits particularly low-noise adjustment of all track wheels to the course of the rail and is able to absorb the high centrifugal forces so that these forces will not affect the running characteristics of the wheels.

Based on the prior-art chassis mentioned in the introduction, the present invention consists of elastically mounting the bearing bracket on a bearing block connected to the frame of the vehicle via a ball-and-socket joint and of supporting it on the frame, likewise via ball-and-socket joints, elastically and in a hinged manner via a connecting rod extending at right angles to the direction of travel.

This measure makes it possible to achieve the advantage that the bearing bracket is designed as a relatively narrow oscillating crank, which is elastically supported at two points against the frame of the vehicle in a hinged manner and which also receives wheel shoes mounted elastically and in a hinged manner, which the wheel shoes extend on both sides of the oscillating crank and thus bring about stabilization of the position of the oscillating crank through the track wheels.

Such a chassis is characterized, in addition, by great damping of the travel noises, because all the hinges and supports are provided with rubber-elastic bodies, which are known per se in mounting engineering.

According to one aspect of the invention, the wheel shoe intended for mounting the upper track wheels is rigidly connected, especially welded, to the bearing bracket. This causes the forces acting on this wheel shoe to be transmitted directly to the bearing bracket, which is able to follow the movements of the wheel shoe, because it is elastically guided on the bearing block and the connecting rod. In addition, as a consequence of this elastic mounting, the forces generated during travel in curves, uphill and downhill sections, which act on the chassis, are essentially prevented from being transmitted to the vehicle itself.

In an exemplified design embodiment of the present invention, the wheel shoe intended for mounting the upper track wheels has a frame-like middle part with wheel shoe levers joining it in opposite directions, wherein the middle part surrounds the bearing block connected to the frame of the vehicle and has hubs arranged at spaced locations from one another for receiving and fastening a bolt passing through the elastic ball-and-socket joint.

This measure facilitates, in particular, the mounting of the chassis on the frame and reduces the space requirement for the chassis.

The individual wheel shoe intended for mounting the lower and lateral track wheels, respectively, is elastically mounted on the bearing bracket via a ball-and-socket joint, on one hand, and is elastically supported against the bearing bracket in the radial direction relative to the rail, on the other hand. This leads to the advantage that the movement of the bearing bracket generated by the upper track wheels does not affect the contact between the lateral and lower track wheels, on one hand, and the rail, on the other hand, because these lateral and lower track wheels adapt themselves to the conditions of the rail independently from each other.

In a design variant, the individual pivotable wheel shoe consists of a housing-like middle part with two wheel shoe levers joining it in opposite directions, and with a hub extending at right angles to the wheel shoe levers, wherein the middle part comprises a support body and the hub comprises a ball-and-socket joint type bearing body made of rubber or the like.

It is recommended that a screw guided in the bearing bracket be adjustable against the support body in the direction of the rail The bearing body preferably consists of two ball-and-socket joints arranged axially one behind the other, which are tensioned together with the bearing bracket by means of a bolt passing through both ball-and-socket joints. Such ball-and-socket joints have been known, e.g., under the trademark "SPH Ä RIBIOC".

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
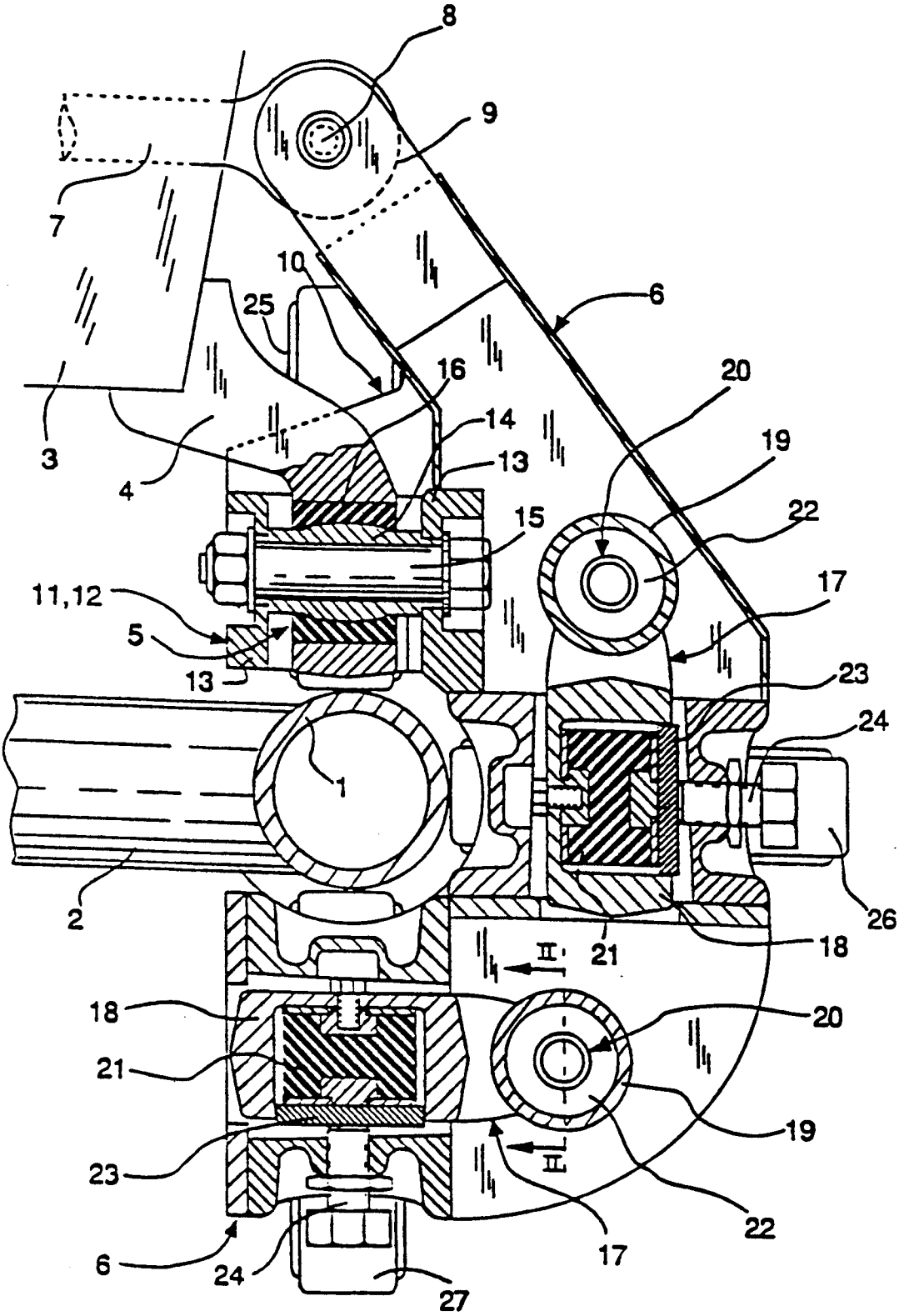
FIG. 1 is a cross sectional view taken through a rail with the bearing bracket mounted on the vehicle.

In the embodiment according to FIG. 1, the cross section of a rail designed as a pipe is shown. This rail is firmly connected to traverses 2 at certain points. Two of the rails 1 with the traverses 2 usually form a frame, which is fastened on posts. A vehicle frame 3 carries in a hinged manner an individual chassis, which consists essentially of a bearing bracket 6, on which upper track wheels 25, lower track wheels 27, and lateral track wheels 26 are mounted in pairs see also FIG. 2.

One bearing block 4, which has a ball-and-socket joint 5 for mounting the bearing bracket 6, is fastened on the frame 3 for each bearing bracket 6. The ball-and-socket joint consists of a rubber body 16, which is guided in the bearing block 4 and has a concave inner wall, with which a ball sleeve 14, which is mounted on the hubs 13 of the bearing bracket 6 via a bolt 15, is engaged. The hubs 13 are part of a wheel shoe 11 for the upper track wheels 25. The wheel shoe 11 is firmly connected to the bearing bracket 6 by welding. The outer hub 13 is supported against the bearing bracket 6 via a shoulder 10.

This mounting of the bearing bracket 6 around the ball-and-socket joint 5 enables the bearing bracket 6 to perform three-dimensional movements around the ball-and-socket joint 5. To absorb the oscillating movement generated by centrifugal force, the bearing bracket 6 is hinged to the frame 3 of the vehicle via a connecting rod 7. In the example shown in FIG. 1, the arrangement of an elastic ball-and-socket joint 8 on an eye 9 of the bearing bracket 6 is shown symbolically. At the other end not shown of the connecting rod 7, an identical mounting of the connecting rod 7 is provided on the frame 3 of the vehicle. The connecting rod 7 extends at right angles to the longitudinal axis of the rail 1 and therefore it absorbs pulling and pressing forces which act on the bearing bracket 6 via the track wheels 25, 26, 27 during high-speed travel in curves. As a consequence of the elastic design of the ball-and-socket joint 8, e.g., due to appropriately shaped rubber bodies, the bearing bracket 6 can also be pivoted through a certain angle around the axis of the bolt 5, and thus the bearing bracket 6 is able to adapt itself to the position that is imposed by the track wheels 25, 26, 27 during travel in curves as well as uphill and downhill sections.

Figure 2:
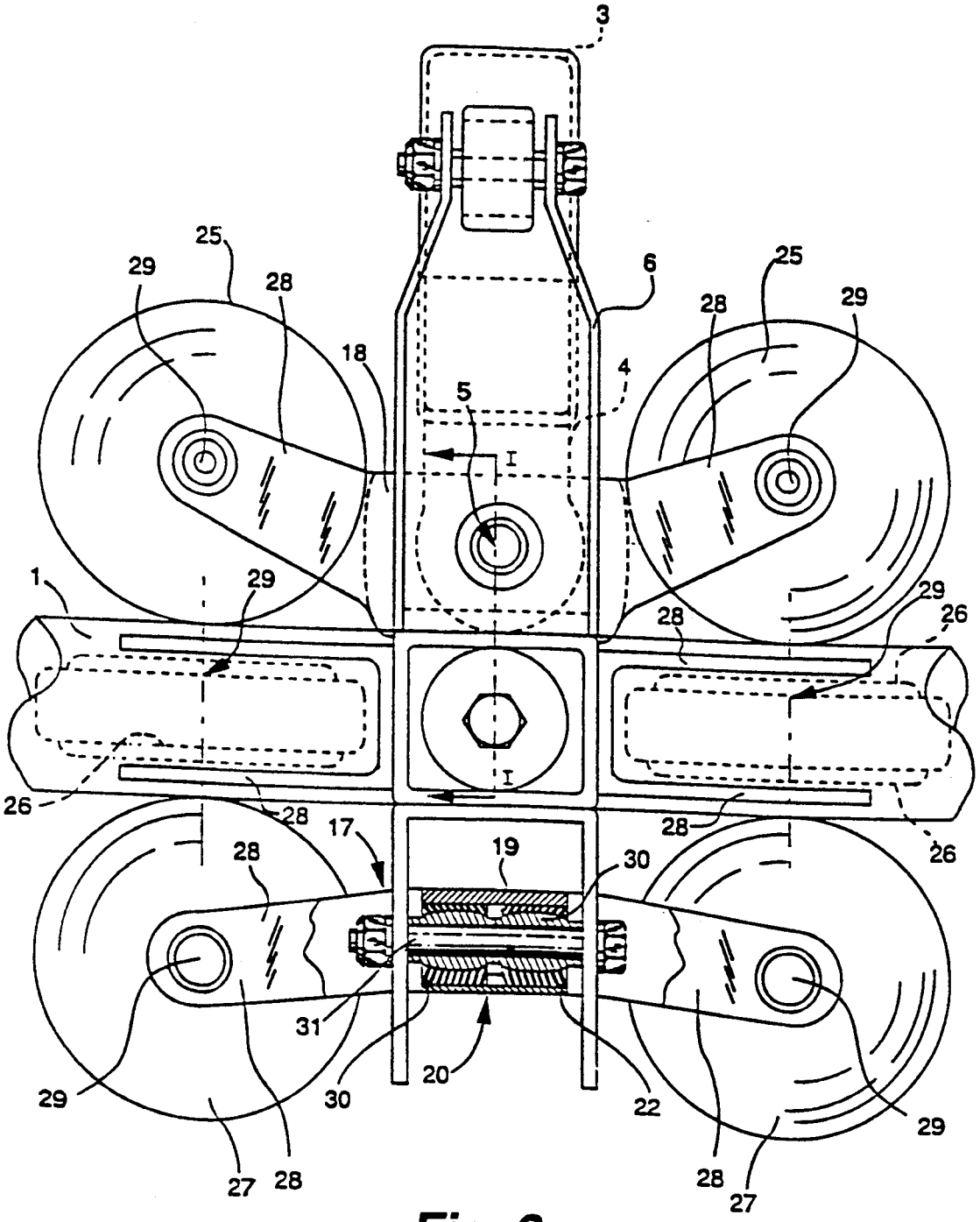
FIG. 2 is a side view of the chassis according to FIG. 1.

The wheel shoes 17 for the lateral track wheels 26 and for the lower track wheels 27 are rotatably suspended on the bearing bracket 6 and are, in addition, elastically supported in the radial direction relative to the rail 1. As is shown in FIGS. 1 and 2, the individual wheel shoe 17 has a housing-like middle part 18, which is joined by wheel shoe levers 28 extending in opposite directions. In addition, the middle part 18 is provided, on the side, with a hub 19, whose axis extends in parallel to the axis of the rail 1. As is shown in FIG. 2, the hub 19 is guided torsionally elastically on the bearing bracket 6 via two ball-and-socket joints 20 arranged one behind another. The individual ball-and-socket joint 20 consists of a bearing body 22 made from rubber or the like, with a concave inner surface, with which engages a ball sleeve 30, which is tensioned together with the bearing bracket 6 via a bolt 31. As a consequence of this arrangement, the wheel shoe 17 is able to perform elastic evading movements around the axis of the bolt 31, on one hand, and in radial directions relative to this axis, on the other hand.

As is shown in a sectional view in FIG. 1, a support body 21 made from rubber or the like, on which a screw 24 acts via the plate 23, is arranged in the housing-like middle part 18 of the wheel shoe 17. The screw 24 guided in the bearing bracket 6 offers the possibility of adjusting the wheel shoe 17 and consequently the track wheels 27 and 26, respectively, radially against the rail and thus determining the contact pressure. Unevennesses or radial forces are absorbed by the elasticity of the support body 21.

Figure 3:
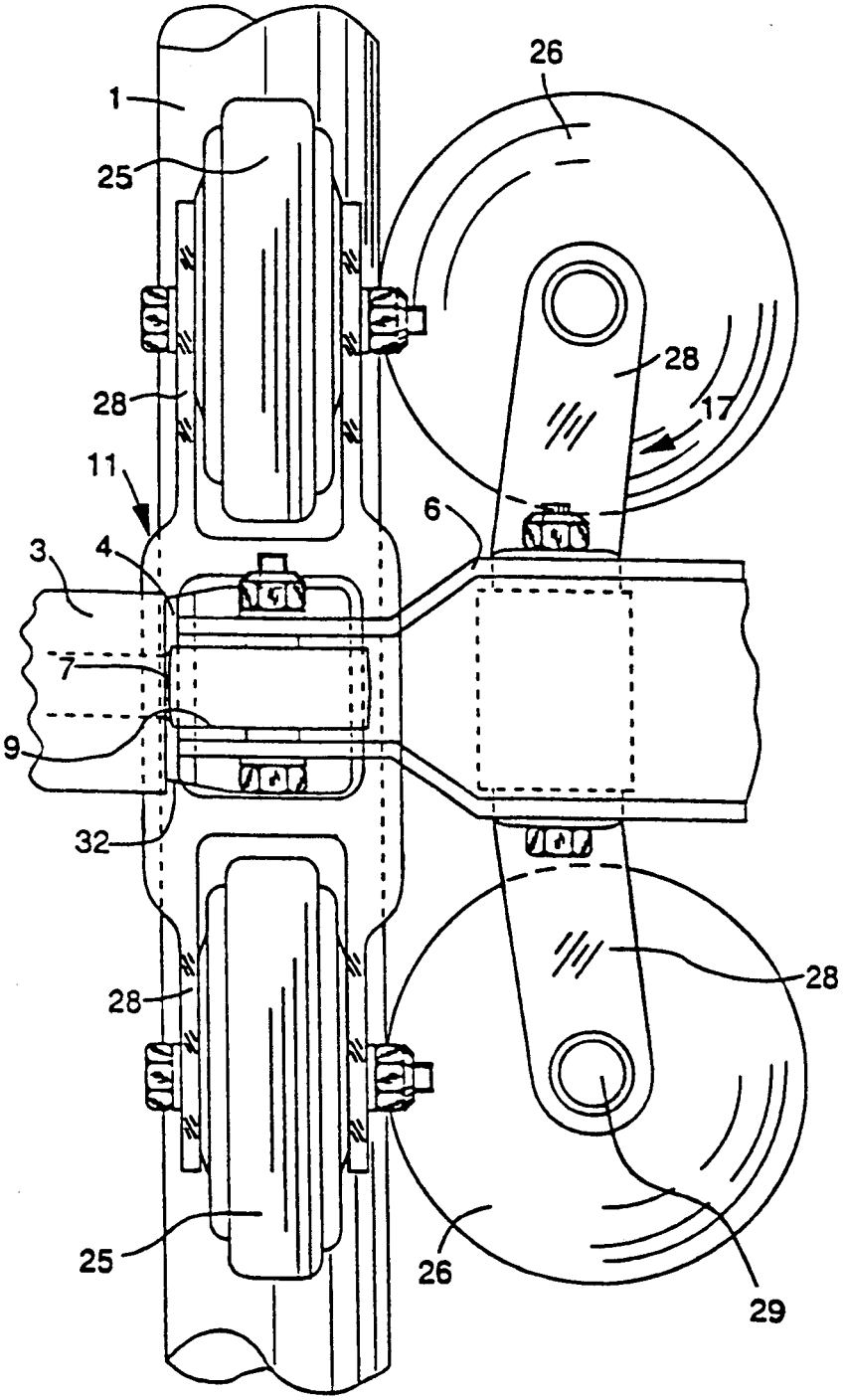
FIG. 3 is a top view of the chassis according to FIGS. 1 and 2.

As was mentioned above, the wheel shoe lever 28 for the upper track wheels 25 is rigidly connected to the bearing bracket 6. As is shown in FIG. 3, this wheel shoe lever has a frame-like middle part 32, which is provided with the hubs 13 compare FIG. 1 and surrounds the ball-and-socket joint 5 of the bearing block 4. Thus, particularly simple installation of the bearing bracket 6 on the bearing block 4 is ensured.

The individual track wheels 25, 26, 27 are mounted on their wheel shoe levers 28 in a noise-damping manner, and it is also advantageous for the track wheels 25, 26, 27 to be provided with rubber-elastic intermediate layers. Such designs have been known from the prior state of the art and therefore need not be described separately.

While a specific embodiment of the invention has been shown and described in detail to illustrate the application of the principles of the invention, it will be understood that the invention may be embodied otherwise without departing from such principles.

I claim:

1. A chassis for rail-bound amusement vehicles, comprising;

a vehicle frame;

a bearing block connected to said vehicle frame;

a bearing bracket;

a ball-and-socket joint connecting said bearing bracket to said bearing block;

wheel shoe means, connected to said bearing bracket, said wheel shoe means for hingedly supporting track wheel pairs with respect to said bearing bracket including wheel pairs engaging the rail from the top, wheel pairs engaging the rail from the bottom and wheel pairs engaging the rail from the side;

a connecting rod extending substantially at right angles with respect to said rail, said connecting rod being connected to said vehicle frame; and a connecting rod ball-and-socket joint connecting said connecting rod to said bearing bracket.

2. A chassis for rail-bound amusement vehicles according to claim 1, wherein said wheel shoe means includes a wheel shoe connected to said bearing bracket supporting said wheel pair for engaging said rail from the top.

3. A chassis for rail-bound amusement vehicles according to claim 1, wherein said wheel shoe means includes an upper wheel shoe for mounting said wheel pair engaging the rail from the top, said upper wheel shoe including a frame middle part and wheel shoe rubbers connected to said frame middle part and extending in opposite directions, said frame middle part surrounding said bearing block and including hubs arranges at spaced locations from each other for receiving a fastening bolt passing through said elastic ball-and-socket joint.

4. A chassis for rail-bound amusement vehicles according to claim 1, wherein said wheel shoe means includes an individual wheel shoe mounted elastically on said bearing bracket via an individual wheel shoe ball-and-socket joint and additionally mounted elastically for support against said bearing bracket in a radial direction relative to the rail.

5. A chassis for rail-bound amusement vehicles according to claim 1, wherein said wheel shoe means includes a housing middle part and two shoe levers connected to said housing middle part and extending in opposite directions from said housing middle part and including a hub extending in a direction substantially perpendicular to said wheel shoe levers, said hub including a hub ball-and-socket joint.

6. A chassis for rail-bound amusement vehicles according to claim 5, wherein said middle part includes a support body, a screw connected to said bearing bracket acting against said support body for adjusting said support body in a direction of the rail.

7. A chassis for rail-bound amusement vehicles according to claim 5, wherein said ball-and-socket joint type bearing body includes two ball-and-socket joints arranged axially, one behind another, said two ball-and-socket joints and a screw passing through said two ball-and-socket joints for tensioning said two ball-and-socket joints to said bearing bracket.

8. A chassis for rail-bound amusement vehicles, comprising:

a vehicle frame;

a bearing block connected to said vehicle frame;

a bearing bracket;

a ball-and-socket joint connecting said bearing bracket to said bearing block;

wheel shoe means, connected to said bearing bracket, said wheel shoe means for hingedly supporting a track upper wheel pair with respect to said bearing bracket, a track lower wheel pair with respect to said bearing bracket and a track side wheel pair with respect to said bearing bracket;

a connecting rod extending substantially at right angles with respect to said rail, said connecting rod being connected to said vehicle frame; and a connecting rod ball-and-socket joint connecting said connecting rod to said bearing bracket.

* * * * *